US010264836B2

(12) United States Patent
Duhatschek et al.

(10) Patent No.: US 10,264,836 B2
(45) Date of Patent: Apr. 23, 2019

(54) FASTENING STRAP FOR FASTENING TO A PROTECTIVE-CLOTHING LOOP FORMED OF A METAL-RING MESH, AS WELL AS PROTECTIVE CLOTHING

(71) Applicant: Friedrich Munch GmbH & Co., KG, Muhlacker (DE)

(72) Inventors: Thomas Duhatschek, Otisheim (DE); Ewald Botcher, Pforzheim (DE)

(73) Assignee: Friedrich Munch GmbH + Co. KG, Muhlacker (DE)

( * ) Notice: Subject to any disclaimer, the term of this patent is extended or adjusted under 35 U.S.C. 154(b) by 564 days.

(21) Appl. No.: 14/426,677

(22) PCT Filed: Sep. 19, 2012

(86) PCT No.: PCT/EP2012/068450
§ 371 (c)(1),
(2) Date: Mar. 6, 2015

(87) PCT Pub. No.: WO2014/037060
PCT Pub. Date: Mar. 13, 2014

(65) Prior Publication Data

US 2015/0208745 A1 Jul. 30, 2015

(30) Foreign Application Priority Data

Sep. 7, 2012 (DE) ..... 20 2012 103 421

(51) Int. Cl.
*A41F 1/06* (2006.01)
*A41D 13/04* (2006.01)
(Continued)

(52) U.S. Cl.
CPC ..... *A41F 1/06* (2013.01); *A41D 13/04* (2013.01); *A41D 13/0518* (2013.01);
(Continued)

(58) Field of Classification Search
CPC ..... A41D 19/0048; A41D 13/08; A41D 19/0034; A41D 19/01511; A43B 11/14;
(Continued)

(56) References Cited

U.S. PATENT DOCUMENTS 2,805,673 A * 9/1957 Solomon ..... A45D 8/34 132/275
3,106,028 A * 10/1963 Baumgartner ..... G09F 3/005 224/221

(Continued)

FOREIGN PATENT DOCUMENTS

GB 2275174 A 8/1994
RU 117781 U1 7/2012

OTHER PUBLICATIONS

Resolution notification of the expert response, dated Feb. 28, 2017, 7 pages.

(Continued)

*Primary Examiner* — Sally Haden
*Assistant Examiner* — Jillian K Pierorazio
(74) *Attorney, Agent, or Firm* — Barley Snyder

(57) ABSTRACT

The present invention relates to a fastening strap 45; 180; 211; 250 for fastening to a loop 35, 40 of protective clothing 10, 50 formed of a metal-ring mesh 26 as well as to such protective clothing 10; 50, the fastening strap 45; 180; 211; 250 comprising at least one engagement element 70; 185 as well as a recess 90; 205 correspondently configured with regard to the engagement element 70; 185, the engagement element 70; 185 and the recess 90; 205 engaging with each other and forming a loop section 155 which is configured to grip the loop 35, 40 of the protective clothing 10; 50 and to fix the fastening strap 45; 180; 211; 250 to the loop 35, 40 of the protective clothing 10; 50.

20 Claims, 17 Drawing Sheets

(51) Int. Cl.

| | |
|---|---|
| ***A41D 13/05*** | (2006.01) |
| ***A41D 19/00*** | (2006.01) |
| ***A41D 19/015*** | (2006.01) |
| ***A42B 3/08*** | (2006.01) |
| ***A41D 13/08*** | (2006.01) |

(52) U.S. Cl.
CPC ..... *A41D 13/0543* (2013.01); *A41D 13/0568* (2013.01); *A41D 13/08* (2013.01); *A41D 19/0044* (2013.01); *A41D 19/01511* (2013.01); *A42B 3/08* (2013.01); *A41D 19/0034* (2013.01); *Y10T 24/14* (2015.01); *Y10T 24/1498* (2015.01)

(58) Field of Classification Search
CPC ..... A43B 11/24; A43B 11/001; A41F 1/06; Y10T 24/1498
USPC ... 2/162, 463, 322, 231, 252, 257, 251, 316, 2/321
See application file for complete search history.

(56) References Cited

U.S. PATENT DOCUMENTS 3,119,118 A * 1/1964 Beebe ..... A41D 19/00 2/159
3,965,952 A * 6/1976 Rivman ..... A44B 17/0029 2/265
4,198,772 A * 4/1980 Furutu ..... G09F 3/00 292/318
3,501,814 A 4/1984 Anderson et al.
4,750,218 A * 6/1988 Ziegler ..... A41F 1/06 2/16
4,800,595 A * 1/1989 Askew ..... A41D 13/0005 2/270
5,054,126 A * 10/1991 Rivkin ..... A41D 19/01511 2/16
5,729,831 A * 3/1998 Kuhlmann ..... A41D 19/01511 2/159
5,894,602 A * 4/1999 Smith ..... A41F 1/06 2/159
6,032,680 A * 3/2000 Lu ..... A45D 8/34 132/273
6,581,885 B2 * 6/2003 Polad ..... F16L 3/137 24/16 PB
7,062,792 B2 * 6/2006 Jaunault ..... A41D 19/0003 2/16
7,188,373 B2 3/2007 Januault et al.
7,703,151 B2 * 4/2010 Blauer ..... A41F 1/00 2/123
8,002,222 B2 * 8/2011 Jaunault ..... A41F 1/06 2/161.6
2004/0006852 A1 * 1/2004 Castro ..... G09F 3/037 24/30.5 R
2004/0025223 A1 * 2/2004 Jaunault ..... A41F 1/06 2/159
2006/0272072 A1 * 12/2006 Murphy ..... A63B 23/12 2/161.1
2008/0000055 A1 1/2008 Kuhlmann
2009/0126168 A1 * 5/2009 Kobe ..... F16B 5/07 24/458
2009/0210992 A1 * 8/2009 Duhatschek ..... A41D 19/01511 2/162

OTHER PUBLICATIONS

English translation of Office Action, dated Aug. 23, 2016, 4 pages.
PCT International Search Report and Written Opinion dated May 15, 2013, 9 pages.
English translation of RU 117781, dated Jul. 10, 2012, 10 pages.
FIIP Decision on Granting A Patent for Invention, dated Jul. 19, 2016, 4 pages.
FIIP Search Report, dated Jun. 15, 2016, 2 pages.
Abstract of RU 117781, dated Jul. 10, 2012, 2 pages.

* cited by examiner

FASTENING STRAP FOR FASTENING TO A PROTECTIVE-CLOTHING LOOP FORMED OF A METAL-RING MESH, AS WELL AS PROTECTIVE CLOTHING

FIELD OF THE INVENTION

The present invention relates to a fastening strap for fastening to loop formed of a metal-ring mesh of protective clothing, as well as to protective clothing, the fastening strap comprising at least one engagement element as well as a recess configured correspondently to the engagement element, the engagement element and the recess engaging with each other and configuring a loop section configured to grip the loop of the protective clothing and to fasten the fastening strap to the loop of the protective clothing.

BACKGROUND

EP 1 919 314 B1 discloses a protective glove made of a metal-ring mesh. In this context, loops are provided at the protective glove through which a fastening strap is threaded. The fastening strap is configured as a flat plastic strap. The fastening strap is equipped with a metal clasp consisting of a snap fastener and a snap fastener buckle. The snap fastener buckle is adjustably arranged at an end of the fastening strap and the snap fastener is fixed to the fastening strap near the other end of the fastening strap by means of a rivet joint.

The above-mentioned protective glove may also be manufactured with a gauntlet consisting of the metal-ring mesh, the gauntlet comprising two fastening straps in this embodiment which are arranged in an area around the wrist of the user and at a rear end of the gauntlet in order to secure the protective glove in its position at the hand or the arm.

It is a disadvantage of the known protective glove that for fastening the fastening strap, two additional metal components are required, i.e. the snap fastener itself and the snap fastener buckle. Both are manufactured in a complex manner from high-quality materials in order to meet the demands of high hygienic standards, e.g. in the meat-processing industry.

SUMMARY

The object underlying the present invention is to improve a fastening strap for protective clothing consisting of a metal-ring mesh of the type referred to above in such a way that the fastening strap is configured hygienically and may be produced in a simple manner. A further object is to reduce the danger of loosing the fastening strap.

The protective clothing according to the invention consisting of a metal-ring mesh comprises a fastening strap and at least one loop formed of the metal-ring mesh. The fastening strap comprises at least an engagement element and a recess configured correspondently to the engagement element. The engagement element and the recess engage with each other and form a loop section which is configured to grip the loop of the protective clothing and to fasten the fastening strap to the loop of the protective clothing.

This embodiment has the advantage that a loss of the fastening strap due to the fastening strap slipping out of the loop of the protective clothing may be prevented. Furthermore, it is particularly easy to exchange a defective fastening strap of the protective clothing.

In a further embodiment, at least one further engagement element and a fastening means configured correspondently to the further engagement element is provided at the fastening strap, the fastening means being configured to at least partially hold the further engagement element. In this way, the protective clothing may easily be secured against slipping e.g. at the wrist or arm, or even at an upper body of the user of the protective clothing by means of the fastening strap.

In a further embodiment, the fastening strap and the further engagement element are made of a plastic material. By using plastic as a material for the fastening strap and for the further engagement element, the weight of protective clothing may be rendered lighter.

Furthermore, an integral configuration of the fastening strap together with the further engagement element prevents dirt from accumulating at the fastening strap, making the fastening strap more hygienic than known fastening straps; moreover, the fastening strap may be cleaned reliably and easily together with the protective clothing. Moreover, a loss of the further engagement element, particularly of a snap fastener, is reliably prevented by the integral configuration.

A further advantage of an integral configuration of the fastening strap and the further engagement element using the same material is that the fastening strap and the further engagement element may be inexpensively manufactured in one single manufacturing step by means of injection moulding.

In a further embodiment, the further engagement element comprises a catch configured to engage behind the fastening means of the fastening strap. In this manner, the fastening strap may simply be tied down, thus securing the protective clothing as well as the fastening strap itself.

In a further embodiment, the catch is circumferentially configured at the further engagement element and preferably arranged at the further engagement element at a distance corresponding to a thickness of the fastening strap. In this manner, a particularly secure fastening of the fastening strap at the further engagement element is provided in order to prevent an involuntary loosening.

In a further embodiment, the further engagement element comprises a section between the catch and the fastening strap, the section having a narrowing configuration in the direction of the catch. This facilitates inserting the further engagement element into the fastening means or, respectively, into the aperture of the fastening strap.

In a further embodiment, the fastening means is configured as an aperture and as a cone in such a way that the narrowing section of the further engagement element contacts the aperture in a two-dimensional manner. In this manner, the further engagement element may be more easily inserted into the aperture and at the same time forces acting upon the further engagement element may reliably be transferred to the aperture and vice versa due to the further engagement element contacting the aperture in a two-dimensional manner.

In this context, it is particularly advantageous if the engagement element has the shape of a mushroom or of a T, and/or if the recess has a T-shape or if the engagement element is configured as a snap fastener and the recess as a bore hole.

In a further embodiment, the engagement element comprises a first slant which is arranged at a surface of the engagement element facing the fastening strap and configured in such a way that when the engagement element engages with the recess, the first slant of the engagement element contacts a first counter surface of the fastening strap correspondently associated with the first slant in a two-dimensional manner and/or the recess comprises a second slant which is arranged in such a way that when the engagement element engages with the recess, the second slant contacts a counter surface of the of the engagement element correspondently associated with the second slant in a two-dimensional manner. In this manner, a wide support area of the engagement element is provided in the area of the recess in order to optimally transfer a force between the engagement element and the fastening strap.

The arrangement is particularly advantageous when the further engagement element is arranged at the fastening strap between the recess and the engagement element. In this manner it is guaranteed that the further engagement element is on the outer side of the protective clothing and thus more easily accessible for the user of the protective clothing in order to fasten the protective clothing e.g. to the arm by means of the fastening strap.

In a further embodiment, the fastening means is arranged at a section of the fastening strap arranged at an end opposite to the engagement element. The arrangement allows for a short configuration of the fastening strap which may consequently be manufactured inexpensively and with a low weight due to a low material demand.

The folding of the fastening strap in the area of the loop section can be supported by a hinge area being provided at the fastening strap between the recess and the engagement element.

The hinge section of the fastening strap may easily be configured by means of a neck in the fastening strap or by choosing a material differing from the plastic material of the fastening strap and having flexible properties.

In a further embodiment, the fastening strap comprises a lower thickness between the engagement element and the hinge area than between the hinge area and the end of the fastening strap opposite to the engagement element. In this manner, the fastening strap may be folded particularly flatly in the loop section.

In a further embodiment, the plastic material of the further engagement element and of the fastening strap is an elastomer, particularly a thermoplastic elastomer.

According to the invention, it was recognized that the above-mentioned object can also be solved by means of protective clothing consisting of a metal-ring mesh comprising an above-described fastening strap and at least one loop formed of the metal-ring mesh. The loop section is configured to grip around the loop of the protective clothing and to fasten the fastening strap to the loop of the protective clothing. Loosing the fastening strap when it is open may thus be prevented.

In a further embodiment, the above-described protective clothing may advantageously be configured as at least one of the following types of clothing: as a glove, particularly as a five-finger glove, as a glove with a protective sleeve, particularly a protection for the entire or part of the arm, as a protective sleeve piece, as a protective leg piece, as a protective shirt, as a protective tunic with/without sleeves, as a pair of protective trousers, as a protective hood, as a protective apron, as a bolero with/without sleeves.

BRIEF DESCRIPTION OF THE DRAWINGS

In the following, the present invention will be explained in more detail in conjunction with the accompanying drawings of which.

In this context, identical components have identical reference numerals.

DETAILED DESCRIPTION OF THE EMBODIMENTS

Figure 1:
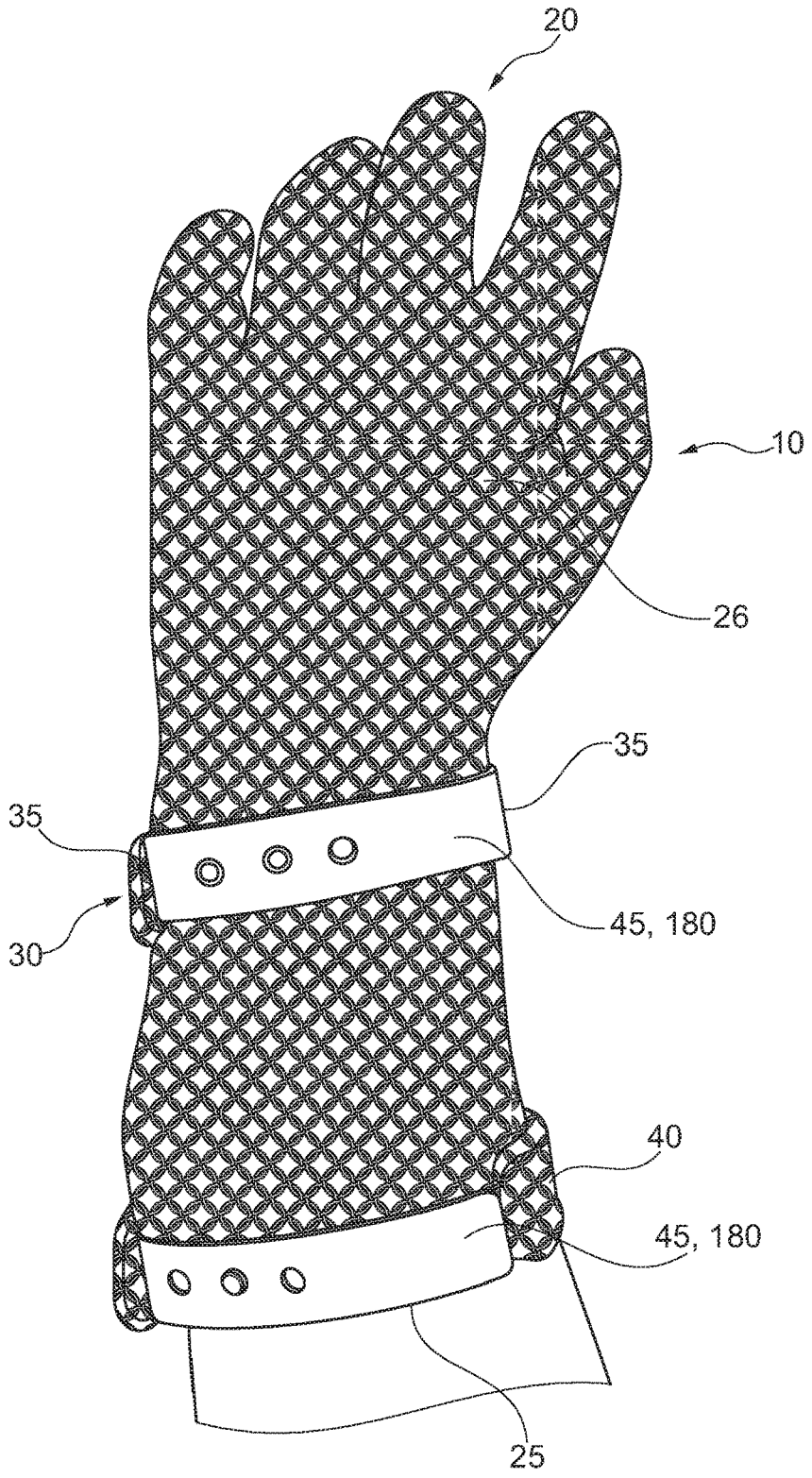
FIG. 1 shows a perspective rear view of a protective glove comprising a gauntlet.
Figure 2:
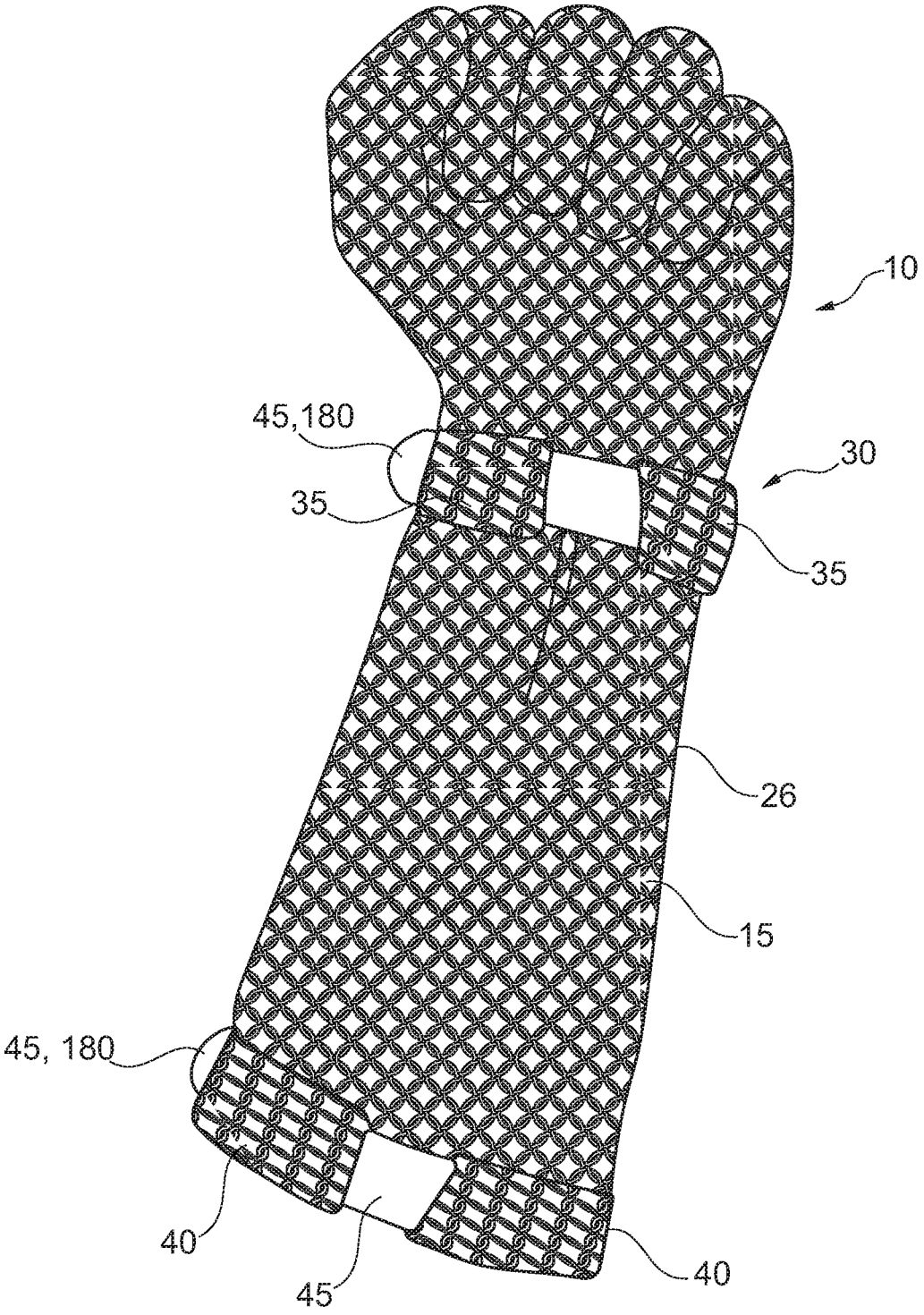
FIG. 2 depicts a front view of the protective glove shown in FIG. 2.

FIG. 1 shows a perspective rear view of a protective glove 10 as a piece of protective clothing comprising a gauntlet 15, and FIG. 2 depicts a front view of the protective glove shown in FIG. 1 which consists of a metal-ring mesh 26 from the finger tips 20 down to the rear rim 25 of the gauntlet 15. The protective gloves 10 shown in FIGS. 1 and 2 in this context serve as personal protective clothing of a user in order to protect the user's body against the penetration of pointy and/or sharp objects, particularly knives.

In the area of the wrist 30 of the protective glove's 10 user, several first loops 35 made of the metal-ring mesh 26 are provided. At a rear rim 25 of the gauntlet 15, several second loops 40 made of the metal-ring mesh 26 are provided. Depending on the breadth of the wrist 30 or, respectively, of a lower arm in the area of the rear rim 25, e.g. three loops 35, 40 may be evenly fastened to the circumference of the wrist 30. Of course, a different number of loops 35, 40 may also be provided in the area of the wrist 30 or, respectively, at the rear rim 25.

The loops 35, 40 may e.g. be configured by providing slits in the metal-ring mesh in circumferential direction around the protective glove, through which a fastening strap 45, 180 is threaded. Alternatively, the loops 35, 40 may also be arranged on the protective glove 10 or, respectively, on the gauntlet 15, by means of a metal-ring mesh having a strap-like configuration and the dimensions of the loops 35, 40, the front and rear rims of the metal-ring mesh 26 being linked with the underlying metal-ring mesh 26.

The first loops 35 as well as the second loops 40 each accommodate a fastening strap 45, 180. Various embodiments of the fastening strap 45, 180 are shown in detail and explained in FIGS. 4 to 18. The fastening strap 45, 180 allows for adjusting the protective glove 10 to different arm or, respectively, wrist thicknesses.

It is to be noted that the gauntlet 15 may not only be configured for protecting the lower arm in the form of a protective half-sleeve, but also as a protection for the entire arm, so that the gauntlet 15 covers an arm over its entire length. The gauntlet 15 may also be configured as protective arm piece or protective leg piece, so that the gauntlet 15 exclusively consists of a metal-ring mesh 26 between the first loop 35 and the second loop 40 and the fastening straps 45, 180 fastened thereto.

Figure 3:
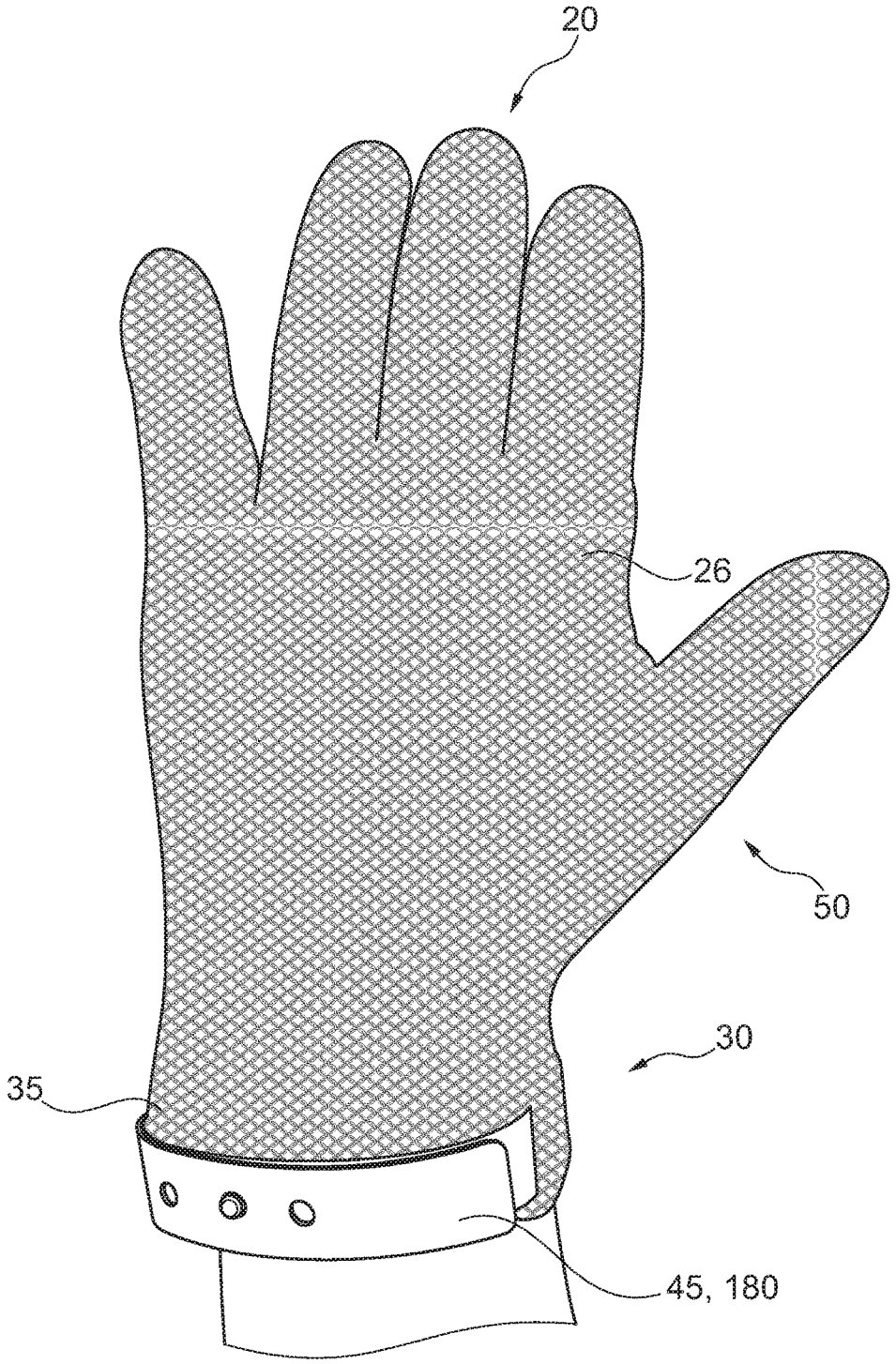
FIG. 3 shows a perspective rear view of a further protective glove.

FIG. 3 shows a perspective view of a further protective glove 50 as protective clothing in an embodiment without the gauntlet shown in FIGS. 1 and 2, so that the protective glove 50 may be easily slipped on if the fastening strap 45, 180 is untied. The protective glove 50 as well as the protective glove shown in FIGS. 1 and 2 comprises a metal-ring mesh 26 and several first loops 35 arranged at the wrist 30, through which, as shown in FIGS. 1 and 2, the fastening strap 45 is threaded. In this embodiment, the fastening strap 45 serves to fix the protective glove 50 to the wrist 30 of the user's hand and prevents the protective glove 50 from slipping off the wrist 30.

In FIGS. 1 to 3, the protective glove 10 is a five-finger glove. Of course, a configuration as mitten or three-finger glove or comprising a different number of fingers is conceivable, as well.

Figure 4:
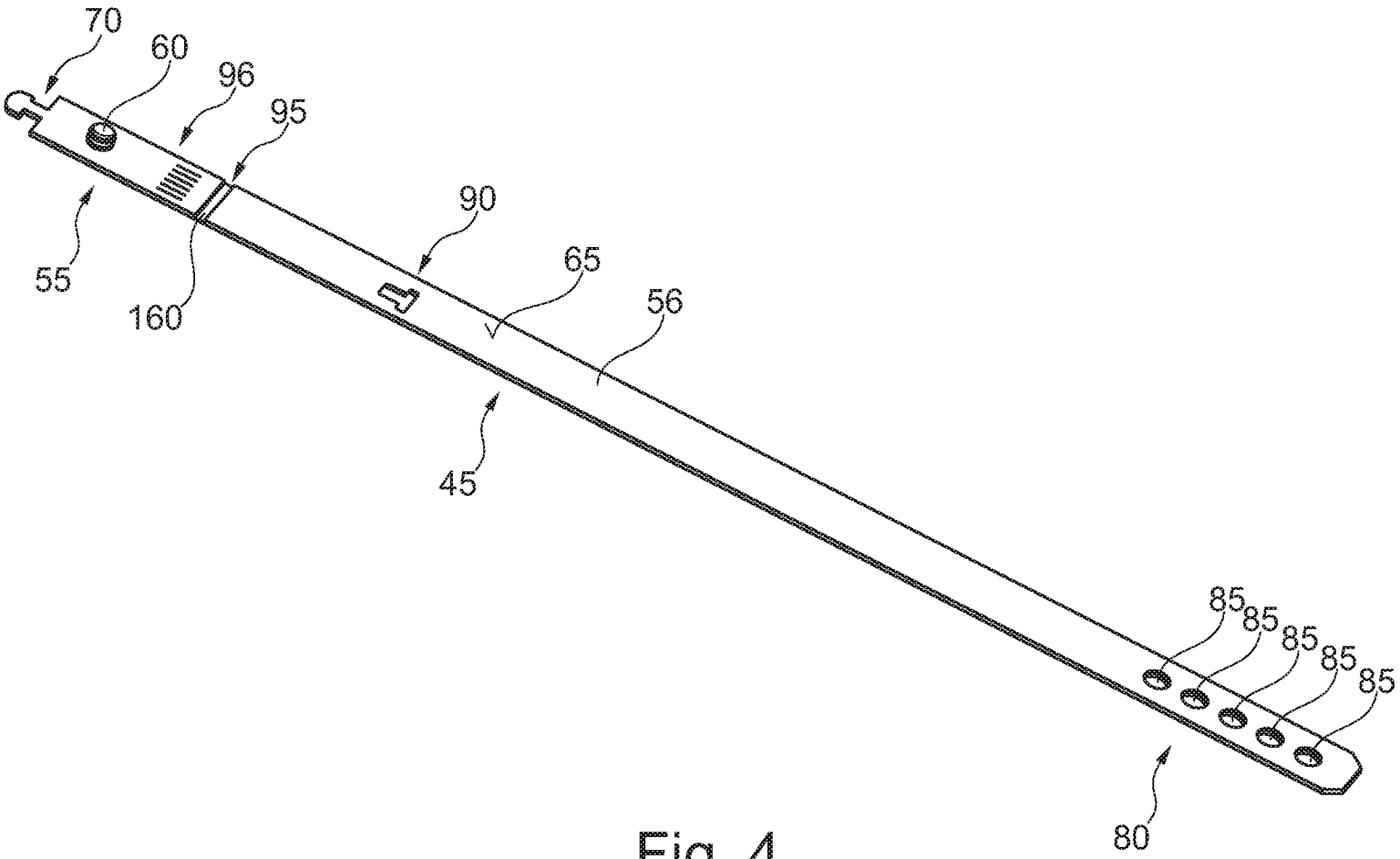
FIG. 4 is a perspective view of a fastening strap of the protective glove shown in FIGS. 1 to 3.
Figure 5:
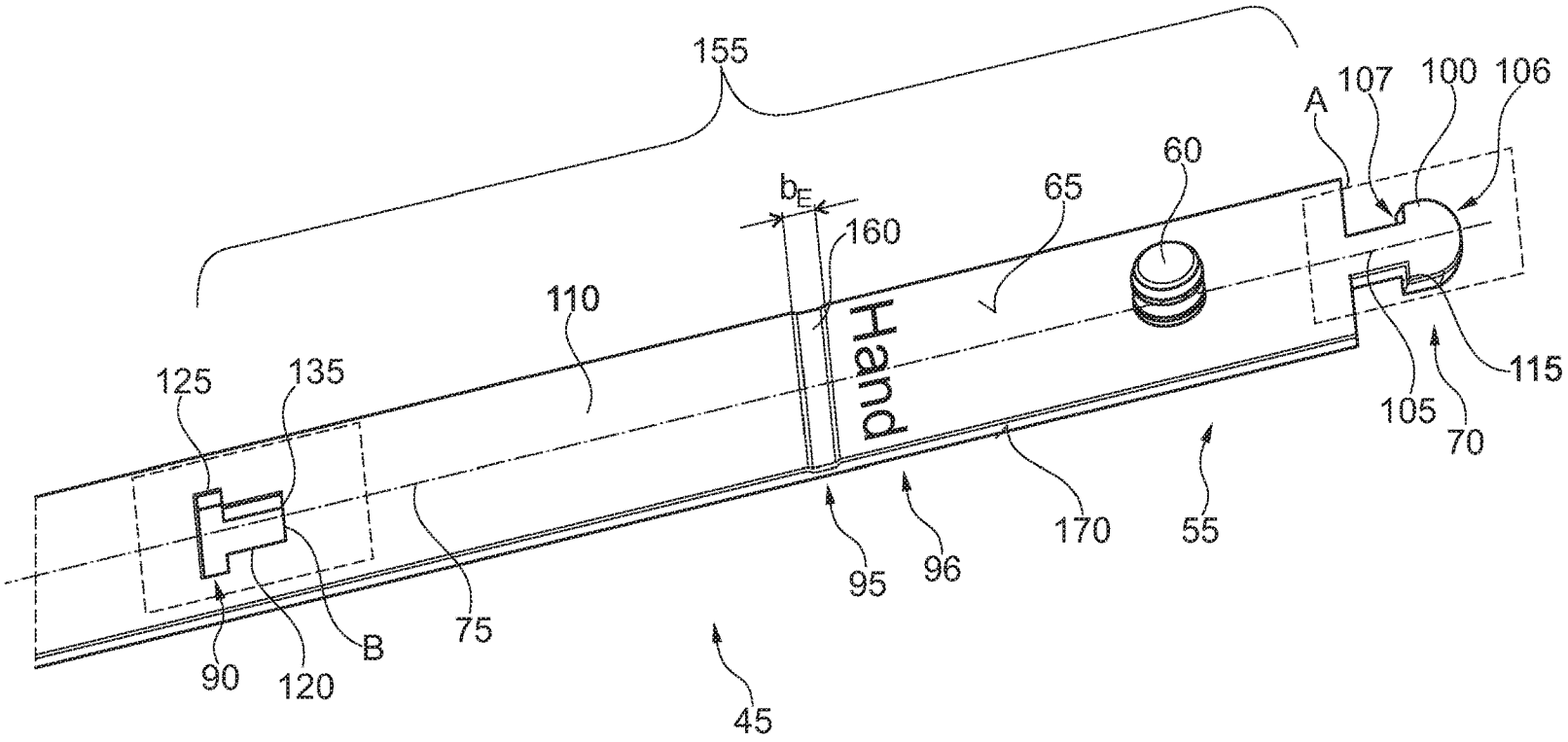
FIG. 5 shows a perspective view of a detail of the fastening strap shown in FIG. 4.
Figure 6:
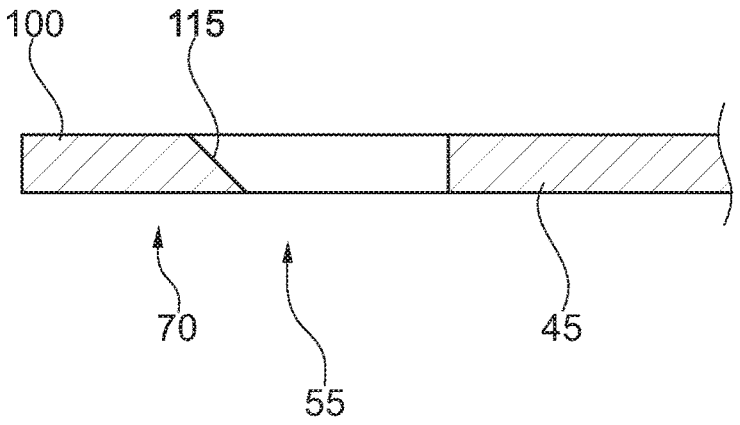
FIG. 6 depicts a detail marked in FIG. 5 and showing a longitudinal cross-section through the fastening strap shown in FIGS. 4 and 5.
Figure 7:
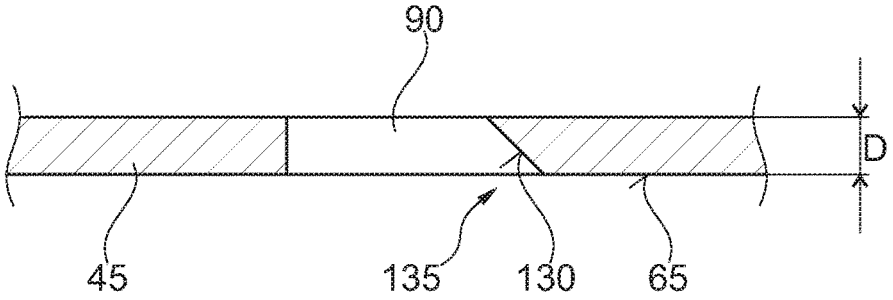
FIG. 7 shows a further detail marked in FIG. 5 and showing a longitudinal cross-section through the fastening strap shown in FIGS. 4 and 5.
Figure 8:
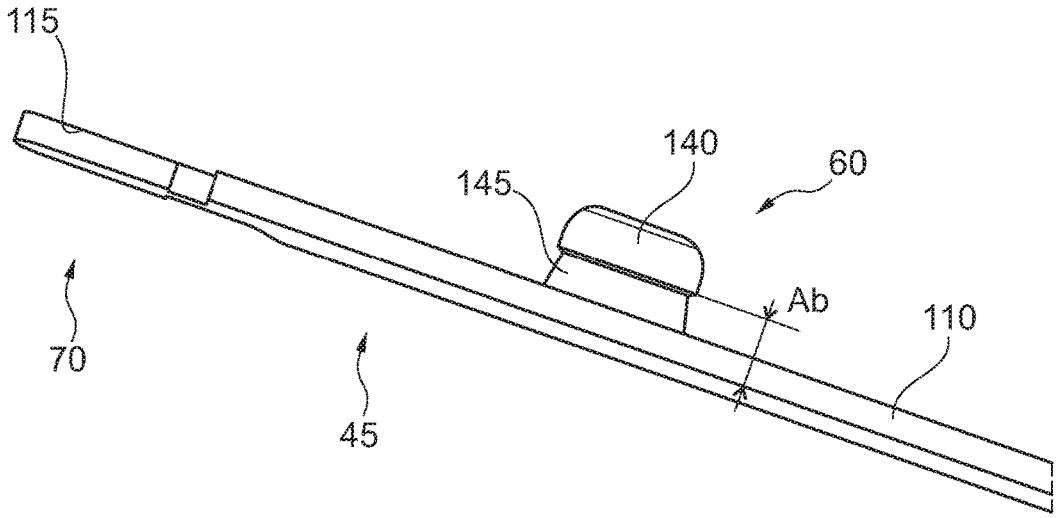
FIG. 8 shows a perspective partial view of an end section of the fastening strap shown in FIG. 4.
Figure 9:
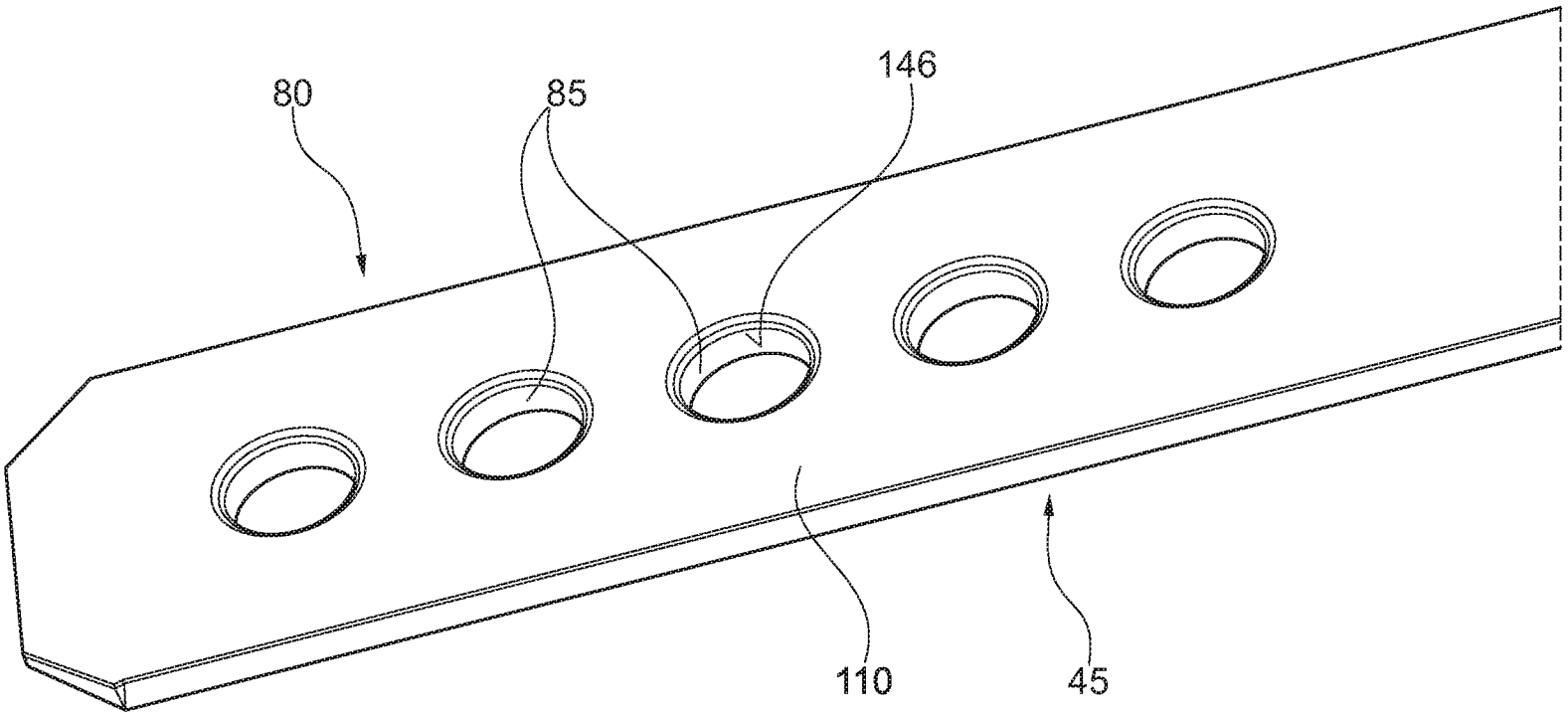
FIG. 9 depicts a perspective partial view of a further end section of the fastening strap shown in FIGS. 4 and 5.
Figure 10:
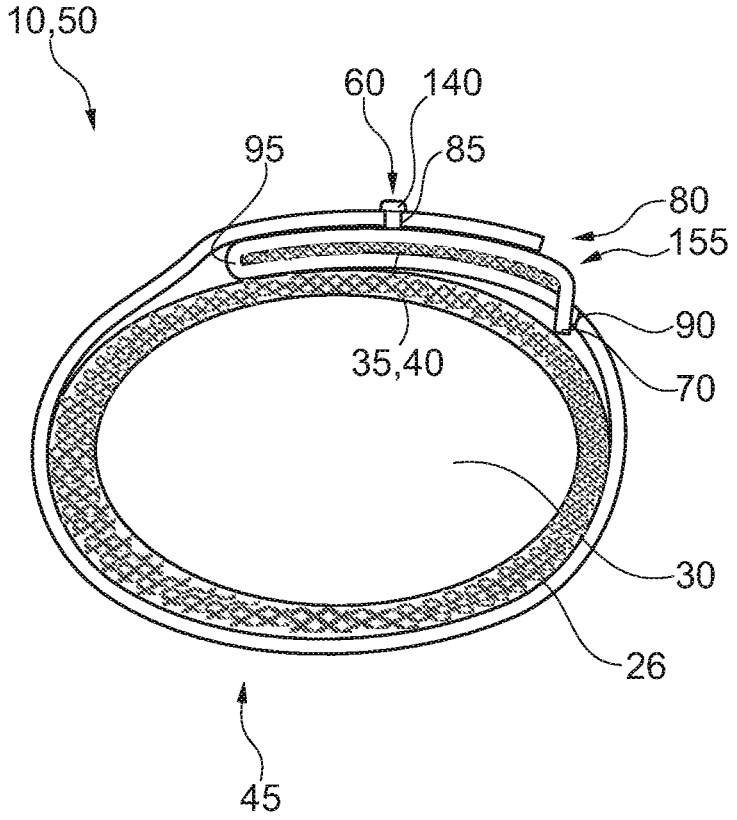
FIG. 10 shows a schematic cross-sectional view through the protective glove shown in FIGS. 1 to 3.
Figure 11:
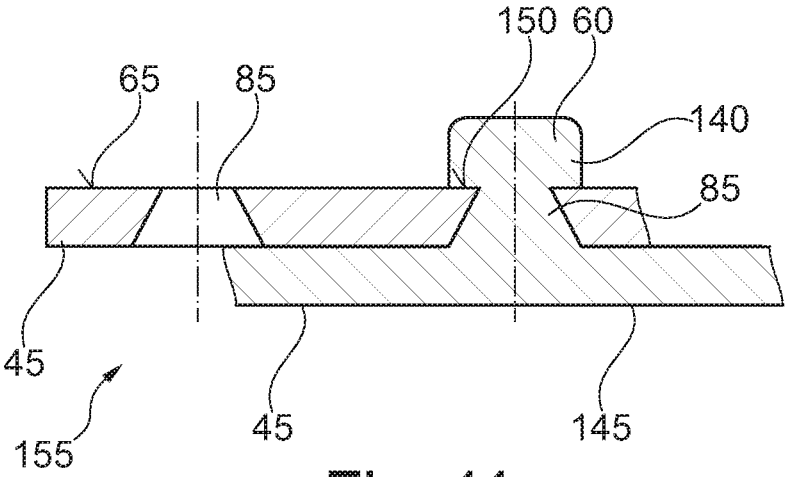
FIG. 11 illustrates a detail of the longitudinal cross-section through the end section of the fastening strap shown in FIG. 10.
Figure 12:
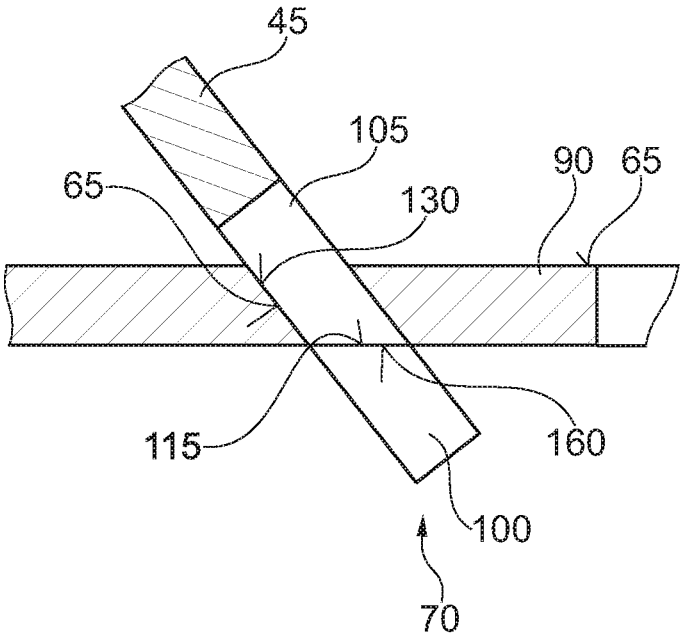
FIG. 12 depicts a detail of a longitudinal cross-section through the further end section of the fastening strap shown in FIG. 10.

FIG. 4 shows a perspective view of the fastening strap 45 of the protective gloves 10, 50 shown in FIGS. 1 to 3. FIG. 5 shows a perspective view of a detail of the fastening strap 45 shown in FIG. 4 and FIG. 6 shows a detail A marked in FIG. 5 of a longitudinal cross-section through the fastening strap 45. FIG. 7 shows a further detail B marked in FIG. 5 of a longitudinal cross-section through the fastening strap 45. FIGS. 8 and 9 show further perspective views of further details of the fastening strap 45 shown in FIG. 4, and FIG. 10 shows a schematic sectional view through the protective glove 10, 50 shown in FIGS. 1 to 3. FIG. 11 further shows a detail of a longitudinal cross-section through the end section of the fastening strap 45 shown in FIG. 10, and FIG. 12 depicts a detail of a longitudinal cross-section through the other end section of the fastening strap 45 illustrated in FIG. 10. In the following, FIGS. 4 to 12 will be explained in conjunction with one another.

The fastening strap 45 is configured as a flat plastic strap, wherein in the area of the first end section 55 a snap fastener 60 is arranged on the broad lateral surface 65 which in FIG. 4 corresponds to the upper surface 65 of the fastening strap 45. Furthermore, an engagement element 70 is arranged at the first end 50 of the fastening strap 45 which sticks out from the first end 55 of the fastening strap 45 in the direction of a longitudinal axis 75 of the fastening strap 45.

At a second end 80 of the fastening strap 45 opposite to the first end 55, several apertures 85 are arranged one after the other in the longitudinal direction of the longitudinal axis 75 in the fastening strap 45 as fastening means. Moreover, a T-shaped recess 90 is provided in the fastening strap 45 between the first end 55 and the second end 80. Furthermore, a hinge area 95 is provided between the recess 90 and the engagement element 70. Moreover, a labelling area 96 is arranged between the hinge area 95 and the snap fastener 60 acting as a further engagement element, wherein various labels of the fastening strap 45 may be inserted into the labelling area 96 by means of embossing. It is thus conceivable, as shown in FIG. 5, to insert the lettering "hand" in the labelling area 96 in order to identify the fastening strap 45 which is provided for the first loops 35 arranged at the wrist 30. By means of this, e.g. different lengths of fastening straps 45 may be labelled. Thus, e.g. a fastening strap 45 which has a shorter configuration may be provided with the label "hand", as shown in FIG. 5, and a non-depicted, longer fastening strap may e.g. be provided with the label "arm".

As an alternative, it is conceivable as well that the fastening strap 45 comprises differing colour particles, depending on its length, in order to colour the fastening strap 45 in accordance with the EN 1082 standard.

The engagement element 70, which is shown in detail in FIG. 5, comprises a head 100 and a longitudinal girder 105 which integrally and by using the same material connects the head 100 to the fastening strap 45. The head 100 of the engagement element 70 in this context has a semi-circular shape, is configured on the surface averted 106 from the fastening strap 45 and has a larger width than the longitudinal girder 105, so that the head 100 in conjunction with the longitudinal girder 105 forms a mushroom-shaped engagement element 70.

Alternatively, it is also conceivable that the head 100 is configured in such a way that the engagement element 70 may be connected to the recess 90 by means of a positively fitting connection and engages behind the fastening strap 45 in the area of the recess 90. In this context, it is particularly conceivable that the head 100 and/or the recess 90 are in the shape of a triangle, a polygon or an ellipsis.

The engagement element 70 further comprises a first slant 115 which is arranged at a lateral surface 107 of the head 100 facing the first end 55 of the fastening strap 45. The slant 115 is in this context arranged in an inclined manner with regard to the surface 65 of the fastening strap 45.

The recess 90 has a T-shape and comprises a longitudinal section 120 aligned in longitudinal direction, i.e. in the direction of the longitudinal axis 75, as well as a transverse section 125 aligned in a traverse manner with regard to the longitudinal axis 75. In this context, the longitudinal section 120 and the traverse section 125 merge in such a way that they form a joint through-hole in the fastening strap 45. Thereby, the longitudinal section 120 is arranged on the side of the transverse section 125 facing the engagement element 70.

The recess 90 comprises a second slant 130 (cf. FIG. 7) which, in the same manner as the first slant 115 of the engagement element 70, is slantly arranged with regard to the upper surface 65 of the fastening strap 110. The second slant 130 is in this context arranged at the lateral surface 135 adjacent to the engagement element 70, i.e. in a base of the T-shaped recess 90 or, respectively, in the longitudinal section 120.

The snap fastener 60, as shown in detail in FIG. 8, extends vertically from the upper surface 65 or, respectively, in a transverse manner with regard to the longitudinal axis 75. The snap fastener 60 as well as the fastening strap 45 are formed of an elastomer, preferably a thermoplastic elastomer, in an integral manner and using the same material. Other plastic materials are conceivable, as well, however, it is essential that these have flexible properties in order to allow for the fastening strap 45 to be bent and folded. Due to the integral configuration, the snap fastener 60 is inseparably connected to the fastening strap 45. The snap fastener 60 further comprises a catch 140 which is configured circumferentially at the snap fastener 60 and which is arranged at a distance Ab from the snap fastener, the distance Ab corresponding to a thickness D of the fastening strap 45. Between the catch 140 and the fastening strap 45, the snap fastener 60 has a narrowing configuration from the fastening strap in the direction of the catch 140 and thus has a tapered shape in the area of this section 145.

At the second end 80 of the fastening strap 45 opposite to the engagement element 70, several apertures 85, as shown in an enlarged manner in FIG. 9, are arranged which are configured correspondently to the narrowing section 145 of the snap fastener 60. If the snap fastener 60 is inserted into the aperture 85, as shown in FIGS. 10 and 11, the snap fastener 60 is partly held by said aperture 85 in the fastening strap 45. In order to enlarge the contact surface between the narrowing section 145 of the snap fastener 60 and the aperture 85, a peripheral area 146 is configured conically in line with the narrowing section 145 so that the peripheral area 146 contacts the narrowing section 145 in a two-dimensional manner.

Due to the corresponding configuration of the peripheral area 146 of the aperture 85 with regard to the narrowing section 145, these components in an assembled state contact each other in a two-dimensional manner, so that forces acting in the direction of the longitudinal axis 75, e.g. resulting from the tensile strain of the fastening strap 45 when fixing the protective glove 10, 50, can be reliably transferred from the snap fastener 60 to the aperture 85. This embodiment of the snap fastener 60 or, respectively, of the aperture 85 together with the catch 140 further prevents the snap fastener 60 from slipping out of the aperture 85. Moreover, inserting or, respectively, pulling through the snap fastener 60 into/through the aperture 85 is facilitated by the cone-shaped configuration of the aperture 85.

The catch 140 is in this context configured in such a way that a locking surface 150 facing the upper surface 65 rests on the upper surface 65 of the slipped-on second end 80 of the fastening strap 45 if the snap fastener 60 is fully inserted. As a result, the snap fastener 60 engages behind the fastening strap 45 in the area of the aperture 85 and secures the second end 80 of the fastening 45 at the protective glove 10, 50 in order to prevent it from loosening. Transverse forces (forces having a vector perpendicular to the upper surface 65 of the fastening strap 45) are transmitted in the direction of the snap fastener 140 by means of the catch 140 due to the interlock of the fastening strap 45 at the snap fastener 60 and in the opposite direction by means of the narrowing section 145 and the peripheral area of the aperture 85.

In the embodiment, the snap fastener 60 as well as the apertures 85 are configured in a rotationally symmetric manner. Of course, other cross-sectional shapes such as rectangular, elliptic or polygon-shaped are conceivable. The essential feature in this context, however, is that the snap fastener 60 is configured integrally and from the same material as the fastening strap 45 and the aperture 85 is configured as a fastening means in order to hold the snap fastener 60.

In order to fix the fastening strap 45 to the protective glove 20, 50, as shown in FIGS. 10 and 11, the engagement element 70 is inserted into the recess 90 through the transverse section 125. Securing the fastening strap 45 at the loop 35, 40 is carried out by sliding the head 100 of the engagement element 70 into the longitudinal section 120 via the transverse section 125. Due to the wider configuration of the head 100 with regard to the longitudinal section 120, the head 100 of the engagement element 70 engages behind the fastening strap 45 in the area of the longitudinal section 120 of the recess 90 so that the engagement element 70 is prevented from slipping out of the recess 90.

When the engagement element 70 engages with the recess 90, the fastening strap 45 forms a loop section 155 which essentially completely grips around the loop 35, 40 in the circumferential direction (cf. FIG. 10), thus reliably securing the fastening strap 45 at the protective glove 10, 50, even if the snap fastener 60 is not inserted into the aperture 85.

The contacting in a two-dimensional manner between the engagement element 70 and the fastening strap 45 which is necessary in order to transmit forces is guaranteed by the first slant 115 being configured in such a way that at the head 100 of the engagement element 70 or, respectively, at the recess 90 the first slant 115 contacts the bottom side 165 of the fastening strap 45 in a two-dimensional manner. Furthermore, the second slant 130 is aligned in such a way that when the engagement element 70 is inserted into the recess 90, the first slant 130 contacts the upper surface 65 of the fastening strap 45 or, respectively, of the longitudinal girder 105 in a two-dimensional manner.

In order to support the folding when inserting the engagement element 70 into the recess 90 in the loop section 155 and in order to provide as flat a configuration of the loop section 155 around the loop 35, 40, the hinge area 95 is essentially arranged in the middle between the recess 90 and the engagement element 70. In the embodiment, the hinge area 95 is configured by means of a groove-shaped neck 160 which is guided along the upper surface 65 in a cross-wise manner with regard to the longitudinal axis 75. In this manner, the material of the fastening strap 45 is weakened in the area of the neck 160 which allows for a particularly easy bending or, respectively, folding. In the embodiment, a width $b_E$ of the neck 160 is selected in such a way that the fastening strap 45 may be folded particularly easily and a particularly flat embodiment of the loop section 155 may be provided without pressing the material in the region of the hinge area 95 or plastically deforming it during folding. This embodiment further has the advantage that a slanted folding is prevented by the lateral stability of the neck 160.

Alternatively, it is conceivable that the neck 160 is arranged on the bottom surface 165 of the fastening strap. Differing from the depiction in Figures, the hinge area 95 may of course also be configured by means of two necks 160 bilaterally arranged on the upper surface 65 and the bottom surface 165. As an alternative, it is conceivable that the neck 160 is arranged on one side or on both sides of a narrow lateral surface 170 of the fastening strap 45. Of course, it is also conceivable that the hinge area 95 or the neck 160 are realized by a softly configured outline of the fastening strap 45.

It is also conceivable that the fastening strap 45 is pre-bent in the region of the hinge area 95 so that the configuration of the loop section 155 is particularly flat.

As an alternative or in addition to the hinge area 95 with a neck 160 shown in the embodiment, it is also conceivable that a material differing from the plastic material of the fastening strap is arranged in the hinge area 95, the flexible properties of which are softer than those of the plastic of the fastening strap 45 in the remaining fastening strap 45. In this context, it is particularly advantageous if the two materials of the hinge area 95 and of the fastening strap 45 are moulded in a die e.g. in a two-component injection moulding process in order to produce a fastening strap 45 in one piece. The two-component injection moulding process offers the advantage that recesses, which are difficult to clean and e.g. caused by the neck 160, are prevented.

It is also conceivable that the fastening strap 45 has a lower thickness D between the hinge area 95 and the engagement element 70 or, respectively, in the loop area 155 than between the hinge area 95 and the second end 80 or, respectively, the engagement element 70 of the fastening strap 45. In this manner, the loop section 155 may be configured in a particularly flat manner.

As mentioned above, the fastening strap 45 is secured at the protective glove 10, 50 by gripping the loop 35, 40 through the loop section 155. The protective glove 10, 50 (cf. FIG. 10) is secured at the wrist 30 by circumferentially guiding the fastening strap 45 around the wrist 30 after slipping the protective glove 10, 50 onto the hand or, respectively, the fingers and the lower arm and by choosing, depending on the circumference of the wrist 30 or of the lower arm, a corresponding aperture 85 through which the snap fastener 60 is inserted. If the snap fastener 60 is inserted completely and if the catch 140 engages, the catch 140 can only be released by means of an increased force so that an involuntary loosening of the fastening strap 45 is prevented.

Due to the integral configuration of the fastening strap 45 with the same material, the protective glove 10, 50 may be cleaned reliably and thoroughly without dirt accumulating in the region of the fastening strap 45. In the same manner, in the case of a wearout of the fastening strap 45, the same may be exchanged simply and without involving any tools. Furthermore, it is not possible that the fastening strap might loose components and thus contaminate food.

Figure 13:
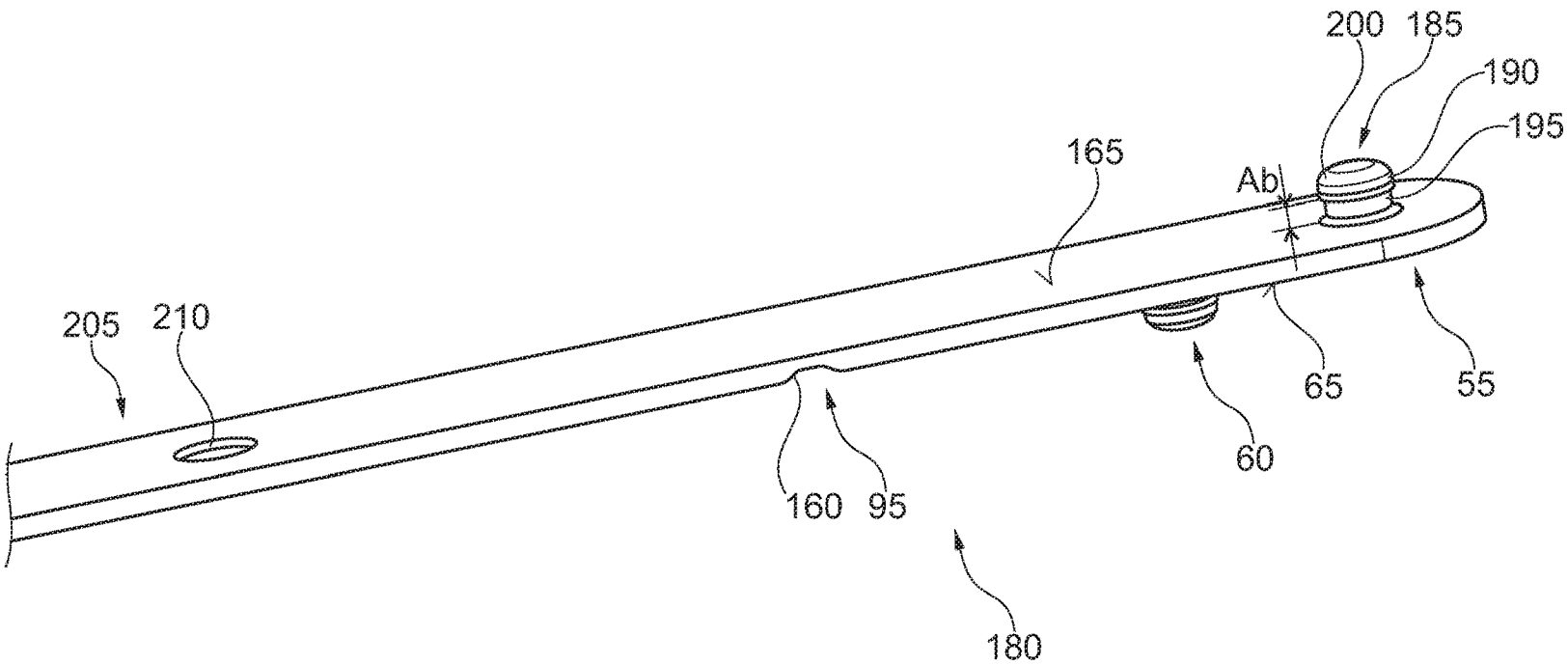
FIG. 13 shows a perspective view of an alternative fastening strap.
Figure 14:
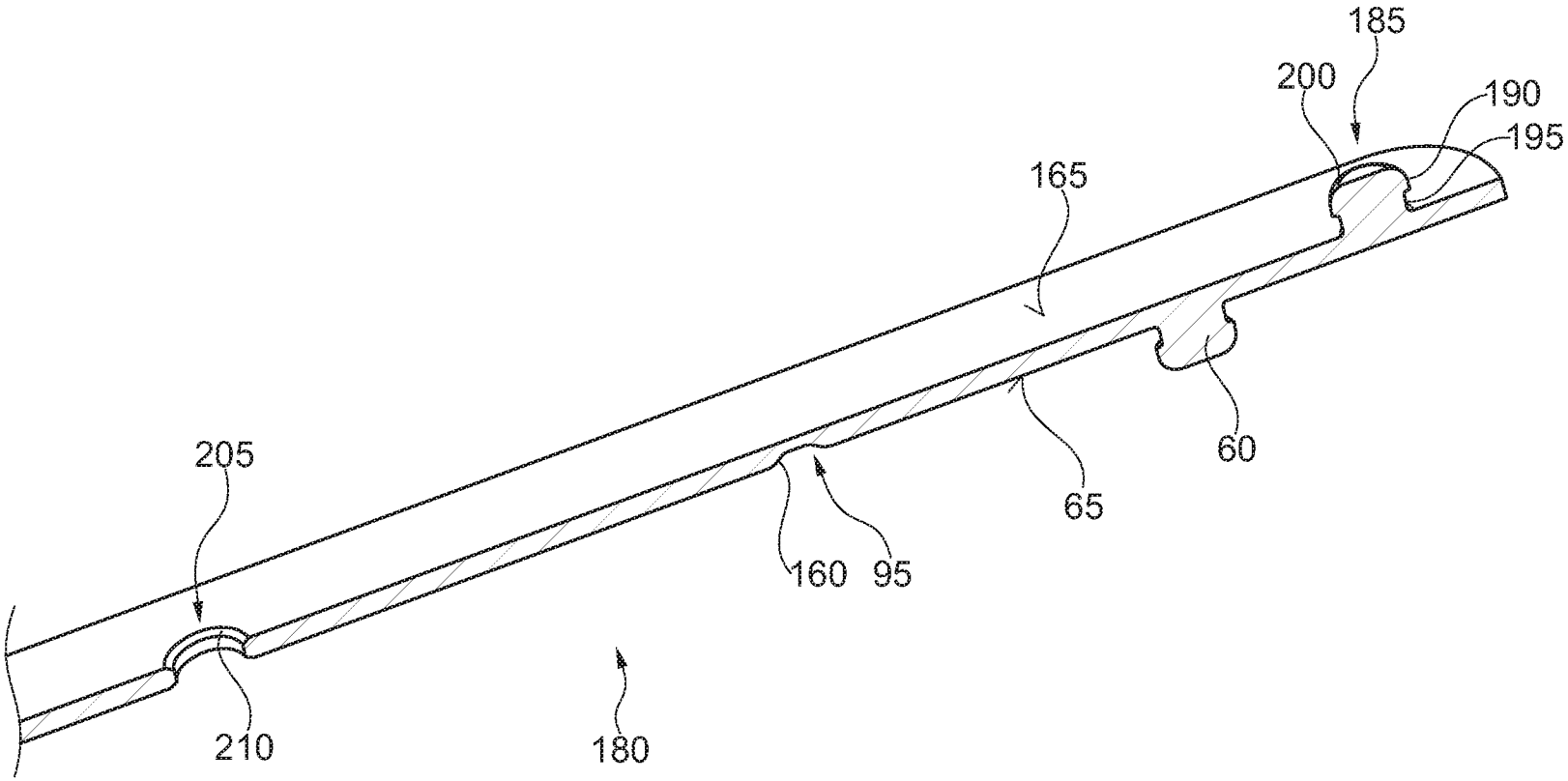
FIG. 14 shows a longitudinal cross-section through the alternative fastening strap shown in FIG. 13.

FIG. 13 shows a perspective view of a further fastening strap 180 and FIG. 14 shows a longitudinal cross-section through the fastening strap 180 shown in FIG. 13. The fastening strap 180 is essentially configured identically to the fastening strap shown in FIGS. 1 to 12. Differing from the embodiment shown in FIGS. 1 to 12, the fastening strap 180 comprises, instead of the T-shaped arrangement of a head and a longitudinal girder shown in FIGS. 1 to 12, a further snap fastener 185 as a engagement element, the snap fastener 185 being arranged on the bottom surface 165 and thus on the opposite side of the snap fastener 60 of the fastening strap 180. In this context, the further snap fastener 185 comprises a circumferentially configured catch 190. Between the catch 190 of the further snap fastener 185 and the fastening strap 180, a cylindrical section 195 is arranged at the further snap fastener 185.

The catch 190 of the further snap fastener 185 comprises a distance Ab which essentially corresponds to the thickness D of the fastening strap 180. The end of the further snap fastener 185 facing away from the fastening strap 180 comprises a rounded edge 200. Furthermore, the first end 55 of the further fastening strap 180 has a rounded configuration in order to avoid that the fastening strap 180 gets caught when the first end 55 is threaded through the loops 35, 40 of the protective glove 10, 50.

In addition to the further snap fastener 185, an aperture 205 configured correspondently to the further snap fastener 185 is provided in the fastening strap 180 as a fastening means. Thereby, the aperture 205 is configured cylindrically as a through-hole. Furthermore, the bore hole 205 on the bottom surface of the fastening strap 180 is slanted by means of a bevel 210.

Figure 15:
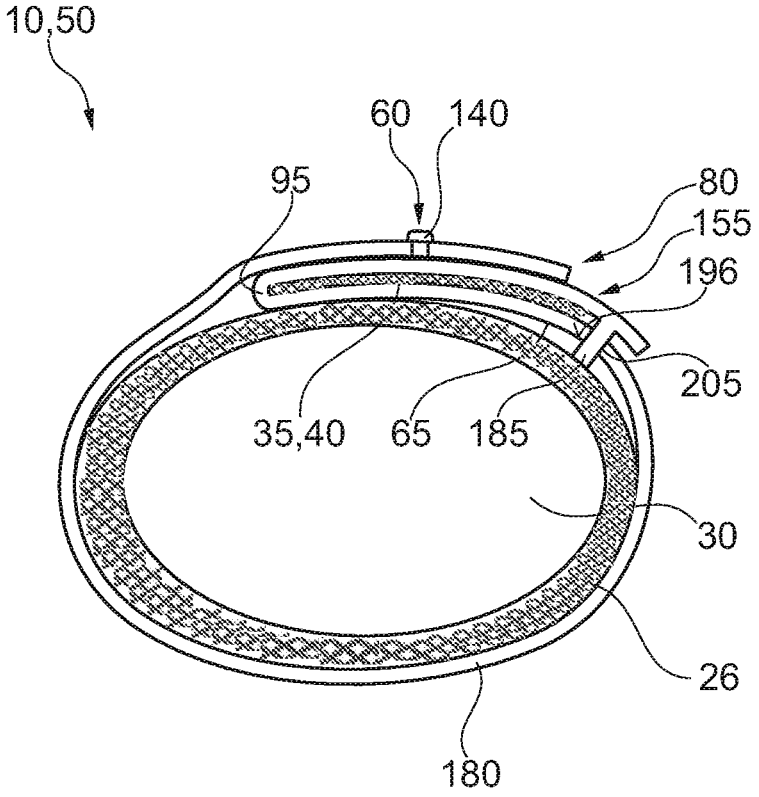
FIG. 15 shows a schematic cross-section through the protective glove depicted in FIGS. 1 to 3 comprising the fastening strap shown in FIG. 13 or, respectively, 14.

FIG. 15 depicts a schematic cross-section through the protective glove 10, 50 shown in FIGS. 1 to 13 comprising the fastening strap 180 depicted in FIGS. 13 and 14. The fastening strap 180 also comprises the loop section 155 which is configured by guiding the first end 55 through the loop 35, 40 and bending it. The bending process is facilitated by the hinge area 95. In order to secure the fastening strap 180 at the loop 35 40, the further snap fastener 185 is inserted into the aperture 205. The rounded edge 200 at the further snap fastener 185 facilitates the insertion of the further snap fastener 185 into the aperture 205. In the same way, inserting the further snap fastener 185 is facilitated by means of a bevel 210 at the aperture 205. The catch 190 of the further snap fastener 185 prevents an independent loosening of the loop section 155 by the fact that, when the further snap fastener 185 is completely inserted, a locking area 196 arranged on the bottom side of the catch 190 contacts the upper surface 65 of the fastening strap 180. In doing so, the catch 190 of the further snap fastener 185 engages behind the further fastening strap 180 in the area of the aperture 205, so that the fastening strap 180 is secured at the loop 35, 40. As shown in FIG. 10, the protective glove 10, 50 is secured at the wrist or, respectively, at the arm by circumferentially guiding the fastening strap 180 around the protective glove 10, 50 after threading through the loop section 155 and the snap fastener engages behind the aperture 85 as described above, thus preventing an independent loosening of the second end 80 of the fastening strap 180 at the protective glove 10, 50.

Figure 16:
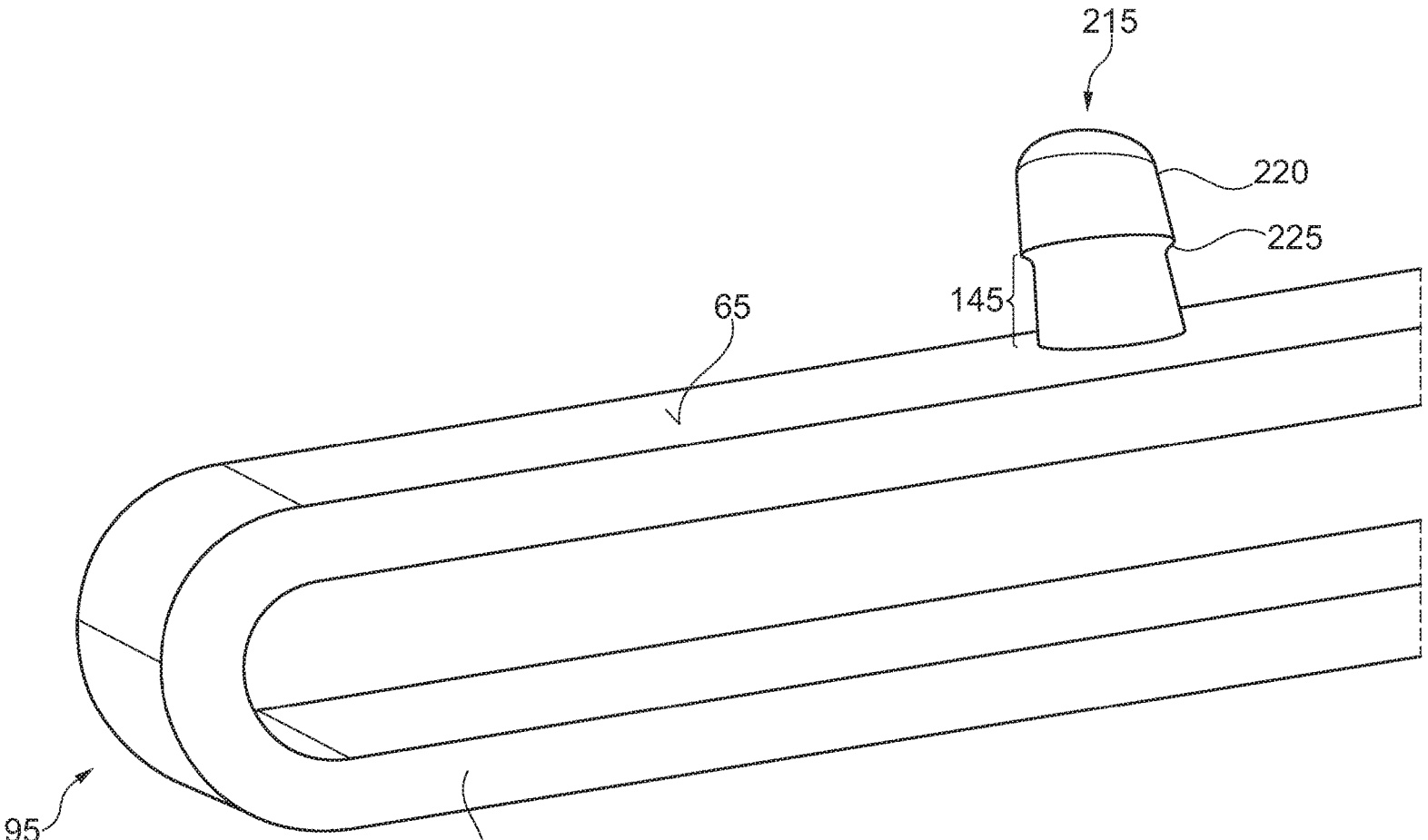
FIG. 16 depicts a perspective partial view of an alternative embodiment of the fastening strap shown in FIG. 8.

FIG. 16 shows a perspective partial view of a further alternative embodiment of the fastening strap shown in FIG. 8. Thereby, an alternative snap fastener 215 is provided at the alternative fastening strap 211 as a further engagement element, which is configured similarly to the snap fastener shown in FIG. 8.

In essence, the snap fastener 215 comprises a rectangular configuration comprising a circumferentially arranged catch 220. As shown in FIG. 8, the narrowing section 145 is arranged between the catch 220 and the upper surface 65 of the fastening strap 211. In this context, the snap fastener 215 comprises a larger extension with regard to its width at the fastening strap 211, i.e. in a cross-wise manner to the longitudinal direction of the fastening strap 211, than the snap fastener shown in FIG. 8. In this context, the catch 220 comprises a locking area 225 arranged opposite to the upper surface 65 of the fastening strap 211. In the embodiment, the catch 220 is completely circumferentially arranged around the rectangular body of the snap fastener 215. Of course, it is also conceivable that the catch 220 is only arranged on one side or only in partial areas of one side of the snap fastener 215. However, it is advantageous if the catch 220 is at least provided at the sides of the snap fastener 215 which cross the longitudinal axis 75 of the fastening strap 211. Due to the rectangular embodiment, the alternative snap fastener 215 may be configured in a slimmer and more compact manner than the snap fastener shown in FIG. 8, while maintaining the same force-transmitting properties.

Figure 17:
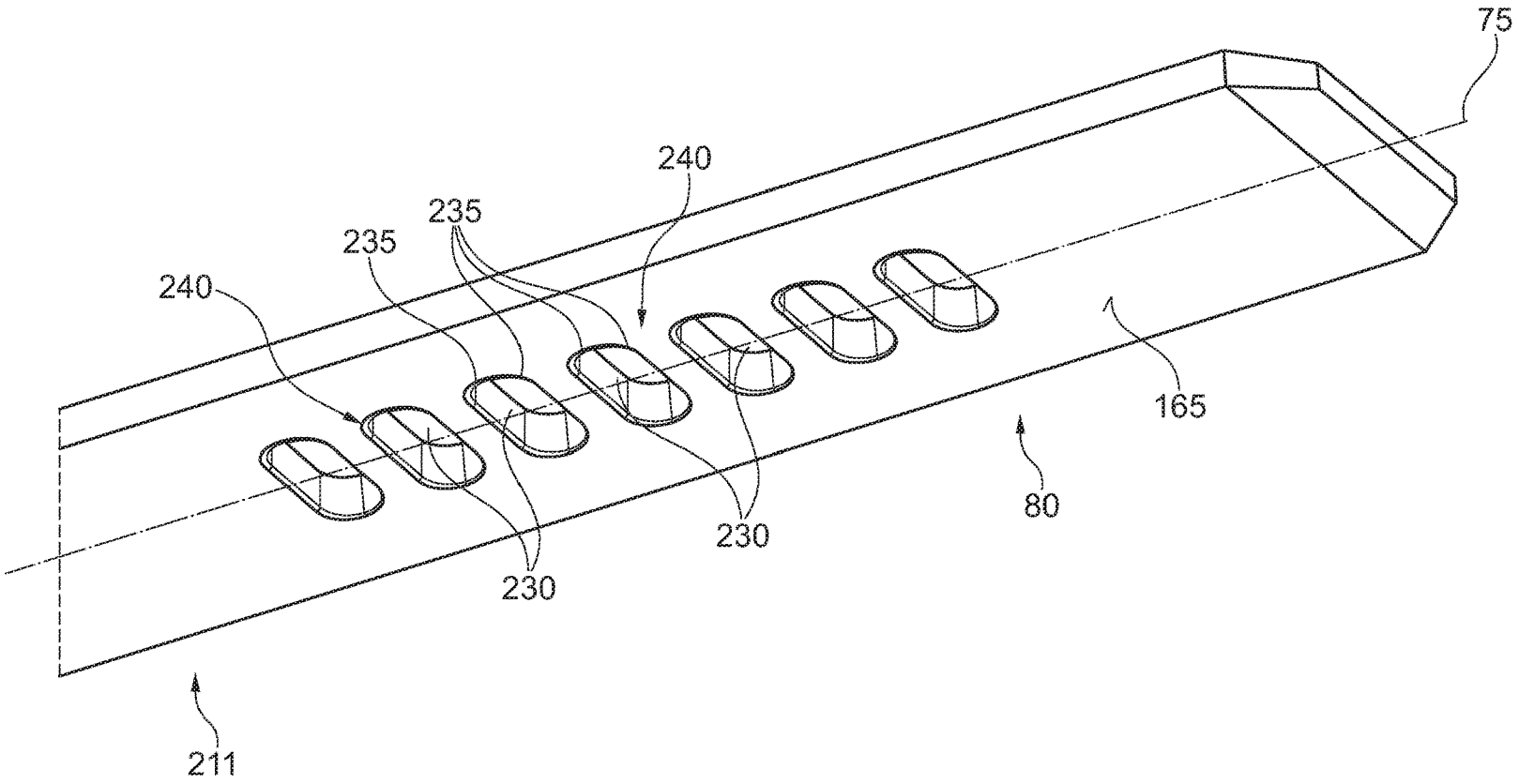
FIG. 17 illustrates a perspective partial view of the fastening strap shown in FIG. 16.

FIG. 17 is a perspective partial view of the fastening strap shown in FIG. 16. The fastening strap 211 comprises several apertures 230 arranged along the longitudinal axis 75, the apertures 230 being configured correspondently to the snap fastener 215 depicted in FIG. 16 and having an essentially rectangular cross-section. In a corner area 235, the rectangular cross-section of the apertures 230 respectively comprises rounded edges 240, thus preventing the fastening strap 211 in the corner region 235 of the apertures 230 from tearing. Furthermore, the fastening strap 211 may be taken from the injection mould in a simple manner after injection moulding.

In order to fix the protective glove 10, 50 to the wrist 30 or, respectively, to the arm, the snap fastener 215 is inserted into the aperture 230 until the bottom surface 165 of the fastening strap 211 contacts the upper surface 65 of the fastening strap 211 in the area of the snap fastener 215 or, respectively, until the snap fastener has fully engaged through the fastening strap 211 and the locking area 225 contacts the upper surface 65 of the fastening strap 211 in the region of the second end 80 of the fastening strap 211. Due to the rectangular configuration of the snap fastener 215 or, respectively, the corresponding configuration of the apertures 230 with regard to the snap fastener 215, a number of apertures 230 may be provided at the second end 80 of the fastening strap 211 which is larger compared to the cylindrical configuration of the apertures so that a more smooth and almost continuous adjustment of the fastening strap 211 to the individual wrist or, respectively, arm circumference of the user of the protective glove 10, 50 may be provided.

Figure 18:
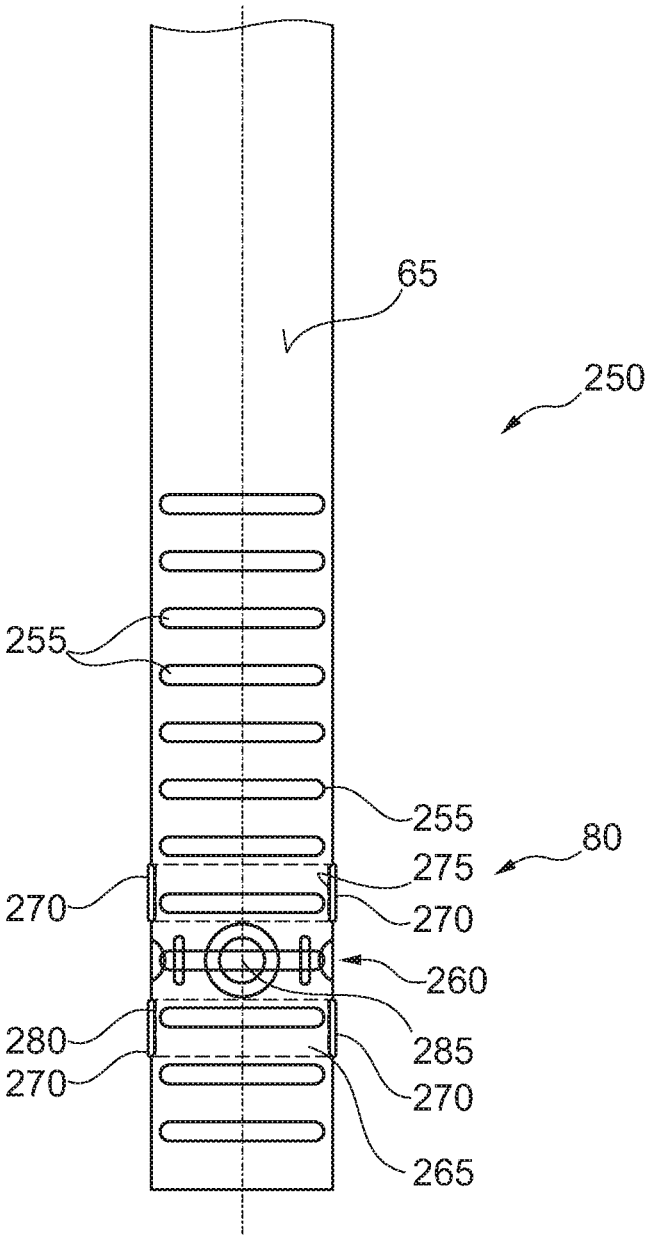
FIG. 18 shows a partial top view of a further alternative embodiment of a fastening strap.

FIG. 18 shows partial top view onto a further alternative embodiment of a fastening strap 250. The further end 80 of the alternative fastening strap 250 shown in FIG. 18 may be combined with the various embodiments of the first end 55 of the fastening straps 45, 180, 211 depicted in conjunction with FIGS. 4 to 17.

The further alternative fastening strap 250 comprises several ribs 255 arranged transversely with regard to the longitudinal axis 75 at an identical distance with regard to one another, the ribs 255 protruding from the upper surface 65 of the fastening strap 250 as bumps. A snap fastener buckle 260 is provided in the area of the ribs 255 of the further end 80 of the fastening strap 250. The snap fastener buckle 260 comprises a bottom 265 which is arranged above the upper surface 65 of the fastening strap 250. Moreover, several bent clip elements 270 are provided on the side of the snap fastener buckle 260, which laterally grip the fastening strap 255 and thus fix the snap fastener buckle 260 to the fastening strap 250. In order to prevent a sliding of the snap fastener buckle 260 in a longitudinal direction, i.e. in the direction of the longitudinal axis 75, two slit-like recesses 275, 280 are provided at the snap fastener buckle 260. The recesses 275, 280 are arranged in the bottom 265 of the snap fastener buckle 260 in such a way that when the snap fastener buckle 260 engages, a rib 255 of the fastening strap 250 respectively engages in a recess 275, 280 of the snap fastener buckle 260. The snap fastener buckle 260 further comprises a receiving opening 285 which is arranged approximately in the middle and is configured with a circular shape corresponding to the snap fastener 60 shown in FIGS. 4 and 5. Of course, the receiving opening 285 may also have a different shape, e.g. a polygon, an ellipsis or a rectangle. The receiving opening 285 is configured to hold the snap fastener 60 shown in FIGS. 4 and 5 in a similar manner as explained in conjunction with FIG. 10 in order to tie the fastening strap 250 and to fix the protective glove 10, 50 to the wrist 30 or, respectively, to the arm.

If the receiving opening 285 has a rectangular configuration corresponding to the snap fastener 215 depicted in FIG. 16, the snap fastener 215 is held by the receiving opening 285, as described above.

By pulling tight the fastening strap 250 at the wrist 30, the ribs 255 are pressed into the recesses 275, 280, which prevents sliding and thus an involuntary displacing or, respectively, loosening of the fastening strap 250. At the same time, the loop section 155 depicted in FIGS. 4 to 17 and a resulting fixing of the fastening strap 250 at the loop 35, 40 of the protective glove can prevent a loss of the fastening strap 250 when the snap fastener buckle 260 is open.

The protective glove described in conjunction with FIGS. 1 to 18 or, respectively, the fastening strap 45, 180, 211, 250 represent a preferred or, respectively, exemplary embodiment of the invention. Moreover, different embodiments are conceivable which may comprise further modifications and/or combinations of features.

For example, it is conceivable that instead of the single-row arrangement of apertures 85, 230 shown in FIGS. 10, 17 as a fastening means, these may also be arranged in two or several rows, if the width of the fastening strap 45, 180, 211 permits. In the case of an arrangement comprising several rows of apertures 85, 230, a corresponding number of rows of snap fasteners 60, 215 would be provided, as well. In the case of an arrangement comprising several rows of snap fasteners 60, 215 and apertures 85, 230, the snap fasteners 60, 215 are held by the apertures 85, 230.

As an alternative to the thermoplastic elastomer as a plastic material for the fastening strap 45, 180, 211, 250 and the snap fastener 60, 185, 215, other elastic plastic materials are, of course, conceivable. However, it is essential that these plastic materials are suitable for use in the food industry.

It is furthermore conceivable that the snap fastener 60, 185, 215 comprises a plastic material different from that of the fastening strap 45, 180, 211, 250 and which is e.g. harder than the plastic of the fastening strap 45, 180, 211, 250. In this context it is advantageous that the snap fastener 60, 185, 215 and the fastening strap 45, 180, 211, 250 may independently from each other be adjusted to the respective mechanical strains. Thereby, the snap fastener 60, 185, 215 and the fastening strap 45, 180, 211, 250 may be manufactured in a two-component injection moulding process so that the snap fastener 60, 185, 215 and the fastening strap 45, 180, 211, 250 are manufactured in one piece with each other, thus reliably preventing a loss of the snap fastener 60, 185, 215. Moreover, dirt accumulations at the fastening strap 45, 180, 215 may be avoided.

As an alternative to the above-described protective glove 10, 50, the protective clothing 10, 50 may be at least one of the following types of clothing: as a glove 10, particularly as a five-finger glove, as a glove 50 with a protective sleeve, particularly a protection for the entire or part of the arm, as a protective sleeve piece, as a protective leg piece, as a shirt, as a tunic with/without sleeves, as a pair of trousers, as a hood for protecting the head or the nape of the neck, as an apron, as a bolero with/without sleeves. The essential feature is that the above-described fastening strap 45, 180, 211, 250 grips a loop 35, 40 of the protective clothing 10, 50 by means of a loop section 155 so that the fastening strap 45, 180, 211, 250 is fixed to the protective clothing 10, 50 even if the fastening strap 45, 180, 211, 250 is open.

The invention claimed is:

1. A protective clothing, comprising: a metal-ring mesh having a loop disposed at only a portion of a circumference of the metal-ring mesh, the loop formed of the metal-ring mesh; and a fastening strap having an engagement element and a recess corresponding to the engagement element, the engagement element engaging the recess to form a loop section extending through and entirely around the loop of the metal-ring mesh, the loop section folded flat around the loop of the metal-ring mesh and fastening the fastening strap to the portion of the circumference of the metal-ring mesh; wherein the fastening strap has a further engagement element and a fastening means, the fastening means corresponding to the further engagement element and configured to at least partially hold the further engagement element; wherein, in an initial fastened state of the fastening strap, the fastening strap is attached to the portion of the circumference of the metal-ring mesh by the loop section extending around the loop of the metal-ring mesh; wherein, in a fully fastened state, the fastening means engages the further engagement element to form an enclosure extending around the entirety of the circumference of the metal-ring mesh, the loop section disposed within the enclosure.

2. The protective clothing of claim 1, wherein the protective clothing is configured as at least one of the following types of clothing: a glove, particularly as a five-finger glove, or as a glove with a protective sleeve, particularly a protection for part of the arm.

3. The protective clothing of claim 1, wherein the fastening strap and the engagement element are formed of a plastic material.

4. The protective clothing of claim 3, wherein a hinge area is provided between the recess and the engagement element, the hinge area is configured to support the folding of the fastening strap in the area of the loop section, wherein the hinge area is a neck in the fastening strap or a material which differs from the plastic material of the fastening strap and has flexible properties.

5. The protective clothing of claim 1, wherein the further engagement element has a catch configured to engage behind the fastening means of the fastening strap.

6. The protective clothing of claim 5, wherein the catch is configured in a circumferential manner at the further engagement element and is arranged at a distance from the fastening strap corresponding to a thickness of the fastening strap at the further engagement element.

7. The protective clothing of claim 5, wherein the further engagement element has a narrowing section between the catch and the fastening strap having a narrowing configuration in a direction of the catch.

8. The protective clothing of claim 7, wherein the fastening means is configured as an aperture and in a conical manner, the narrowing section of the further engagement element contacting the aperture in a two-dimensional manner.

9. The protective clothing of claim 1, wherein the engagement element is configured in the shape of a mushroom or a T and the recess has a T-shape.

10. The protective clothing of claim 1, wherein the engagement element is configured as a snap fastener and the recess as a bore hole.

11. The protective clothing of claim 1, wherein the engagement element has a first slant arranged at a plane of the engagement element facing the fastening strap and being arranged in such a way that when the engagement element engages with the recess, the first slant of the engagement element contacts a first counter surface of the fastening strap correspondently associated with the first slant in a two-dimensional manner.

12. The protective clothing of claim 11, wherein the recess comprises a second slant which is arranged in such a way that when the engagement element engages with the recess, the second slant contacts a second counter surface of the engagement element correspondently associated with the second slant in a two-dimensional manner.

13. The protective clothing of claim 1, wherein the further engagement element is arranged at the fastening strap between the recess and the engagement element.

14. The protective clothing of claim 1, wherein the fastening means is arranged at a section of the fastening strap arranged at an end opposite to the engagement element.

15. The protective clothing of claim 1, wherein a hinge area is provided between the recess and the engagement element, the hinge area is configured to support the folding of the fastening strap in the area of the loop section.

16. The protective clothing claim 15, wherein the fastening strap has a lower thickness between the engagement element and the hinge area than between the hinge area and an end of the fastening strap arranged opposite to the engagement element.

17. The protective clothing of claim 1, wherein the fastening strap and the further engagement element are formed of a thermoplastic elastomer.

18. The protective clothing of claim 1, wherein the metal-ring mesh has a plurality of loops spaced apart from one another around the circumference of the metal-ring mesh, the loop section extending through and entirely around only one of the loops.

19. The protective clothing of claim 1, wherein the loop is disposed on an outside of the metal-ring mesh, a portion of the loop section disposed between an inner side of the loop and the metal-ring mesh.

20. The protective clothing of claim 1, wherein the fastening means is disposed on a portion of the fastening strap outside of the loop section.

* * * * *